United States Patent [19]

Ochi et al.

[11] Patent Number: 4,825,765

[45] Date of Patent: May 2, 1989

[54] DELAY CIRCUIT FOR ELECTRIC BLASTING, DETONATING PRIMER HAVING DELAY CIRCUIT AND SYSTEM FOR ELECTRICALLY BLASTING DETONATING PRIMERS

[75] Inventors: Koji Ochi, Iwamizawa; Masahide Harada, Sapporo, both of Japan

[73] Assignees: Nippon Oil and Fats Co., Ltd.; Harada Electronics Industry, both of Japan

[21] Appl. No.: 97,834

[22] Filed: Sep. 17, 1987

[30] Foreign Application Priority Data

| | | | |
|---|---|---|---|
| Sep. 25, 1986 | [JP] | Japan | 61-224946 |
| Sep. 25, 1986 | [JP] | Japan | 61-224947 |
| Dec. 26, 1986 | [JP] | Japan | 61-308911 |

[51] Int. Cl.[4] ..... F42C 11/06; F42D 1/06

[52] U.S. Cl. ..... 102/206; 102/200; 102/217

[58] Field of Search ..... 102/200, 206, 217, 218, 102/220, 301; 439/292, 293, 296, 357, 358; 361/248, 251

[56] References Cited

U.S. PATENT DOCUMENTS

| | | | |
|---|---|---|---|
| 3,834,310 | 9/1974 | Ueda et al. | 102/206 |
| 4,044,681 | 8/1977 | deMere | 102/206 |
| 4,145,970 | 3/1979 | Hedberg et al. | 102/206 |
| 4,409,897 | 10/1983 | Kirby et al. | 102/200 |
| 4,445,435 | 5/1984 | Oswald | 102/206 |
| 4,487,125 | 12/1984 | Zuk | 102/206 |
| 4,601,243 | 7/1986 | Ueda et al. | 102/206 |
| 4,615,268 | 10/1986 | Nakano et al. | 102/200 |

FOREIGN PATENT DOCUMENTS

| | | | |
|---|---|---|---|
| 208757 | 4/1960 | Austria | 102/206 |
| 0003412 | 8/1979 | European Pat. Off. . | |
| 2331968 | 1/1974 | Fed. Rep. of Germany . | |
| 2356875 | 5/1975 | Fed. Rep. of Germany . | |
| 2574922 | 6/1986 | France . | |
| 54-43454 | 4/1979 | Japan . | |
| 56-26228 | 6/1981 | Japan . | |
| 57-142498 | 9/1982 | Japan . | |
| 58-83200 | 5/1983 | Japan . | |

*Primary Examiner*—Charles T. Jordan

*Attorney, Agent, or Firm*—Arnold, White & Durkee

[57] ABSTRACT

A delay type electric detonating primer for use in a multiple-step blasting system including a capacitor for storing electric changes supplied from an electric blaster via-bus wires and leg wires, an actuation circuit connected across the capacitor for generating an actuation signal when an energy supply from the electric blaster is stopped, a clock pulse generating circuit having a crystal oscillator and being energized with energy stored in the capacitor to produce clock pulses, a counting circuit which is initiated to count the clock pulses in response to the actuation signal, and generates an ignition signal when the counter has counted the predetermined number of clock pulses, and a switching circuit for discharging electric charges stored in the capacitor through an igniting resistor in response to the ignition signal.

21 Claims, 9 Drawing Sheets

FIG_6A Energy Supply
ON
OFF
$t_0$
$t_1$
FIG_6B Actuation Signal
FIG_6C Reference Clock Pulse
FIG_6D $\phi_1$
FIG_6E $\phi_2$
FIG_6F Converted $\phi_1$
FIG_6G Converted $\phi_1$
FIG_6H Voltage Across Capacitor 33
FIG_6I Voltage Across Capacitor 33
$\lambda$
$\varphi$
$T_1$
$T_2$
$V_R$
$t_{E1}$
$t_{E2}$

DELAY CIRCUIT FOR ELECTRIC BLASTING, DETONATING PRIMER HAVING DELAY CIRCUIT AND SYSTEM FOR ELECTRICALLY BLASTING DETONATING PRIMERS

BACKGROUND OF THE INVENTION

Field of the Invention and Related Art Statement

The present invention generally relates to a system for electrically blasting a number of detonating primers in a multiple-step mode, and more particularly to a delay circuit and a detonating primer for use in such a system.

Heretofore, in case of exploding a plurality of explosives at different timings in the multiple-step mode, there are generally used delay type detonating primers. The delay type detonating primer comprises an electric detonating portion including lead wires, bridging wire connected to the lead wires and fuse head applied on the bridging wire, a main explosive, and a time delaying explosive arranged between the electric detonating portion and main explosive. When electric current is supplied to the bridging wire via the lead wires, the fuse head is first ignited. Then the time delaying explosive is fired, and after the time delaying explosive is burnt for a predetermined delay time, the main explosive is exploded subsequently. In this known delay type detonating primer, it is almost impossible to attain the precision of the delay time up to 50% due to the unevenness of the delaying explosive. Moreover, the delay time of the known detonating primer fluctuates greatly due to the variation of ambient temperature and the secular variation. Therefore, the known delay type detonating primers could not be advantageously used in the smooth blasting which requires the high precision of the delay time. Further, when the multiple-step blasting is to be effected in a town, amounts of explosives in each steps. are restricted in view of the noise and vibration, therefore it is necessary to set or control time intervals between successive explosion steps in a more precise manner. However, when use is made of the known delay type detonating primers having large variations in delay time, successive explosion steps might be overlapped partially and, in the extreme case, their order might be inverted.

In order to avoid the above mentioned drawback of the known delay type detonating primer, there has been proposed an electric delay type detonating primer comprising an instantaneous type primer and a delay circuit for delaying electric pulses supplied from an electric blasting apparatus or an electric blaster with the aid of an inductor or capacitor. Known electric delay type detonating primers may be classified into an analog type primer disclosed in Japanese Patent Publication No. 56-26,228, and Japanese Patent Laid-open Publication (Kokai) No. 54-43,454, and a digital type primer described in Japanese Patent Laid-open Publication (Kokai) Nos. 57-142,498 and 58-83,200.

In the analog type detonating primer, there is provided a delay circuit composed of a resistor and capacitor and the precision of the delay time is determined by the accuracy in values of these electronic parts or elements. In industrially used electronic parts, accuracy of values is within a range from several percentages to ten and several percentages. This accuracy of electronic parts is not sufficiently high for obtaining the precise delay time necessary for effecting the smooth blasting.

In the digital type detonating primer, a necessary delay time is obtained by counting the number of pulses generated from an oscillator, so that the precision in delay time can be increased extremely in comparison with the analog type detonating primer. In the known digital type detonating primer, the oscillator is formed by an R-C oscillating circuit including a resistor and capacitor. The frequency of an output signal generated from such an R-C oscillating cirucit is dependent mainly upon the value s of the resistor and capacitor, and thus the precision of the oscillating frequency is lower than an oscillating circuit using a quartz or ceramic vibrator which is usually utilized in a circuit such as a digital watch circuit in which a signal having a precise frequency is required. It is expected to obtain a precise electric detonating primer if a counter and an oscillator having the quartz or ceramic vibrator are combined with each other. However, the quartz and ceramic vibrators require a rise or transient time of 200 to 300 ms until they begin to vibrate stably at a desired frequency. In case of installing these vibrators in the detonating primer, the rise time becomes an error in the delay time. Therefore, in the known electric delay type detonating primer, the R-C oscillator having the low frequency precision has to be used. This problem is not inherent to the detonating primer, but is equally applied to a delay type detonating fuse.

SUMMARY OF THE INVENTION

The present invention has for its object to provide a novel and useful delay circuit for electrical blasting, which can avoid the above mentioned drawbacks and a delay time can be set very precisely by using a highly precise oscillating circuit including a quartz or ceramic vibrator.

According to the invention, a delay circuit for use in electric blasting comprises a capacitor for storing electric energy supplied from an energy supply source;

an actuation circuit for detecting a stop of the supply of said electric energy from the energy supply source to generate an actuation signal;

a clock pulse generating circuit energized with energy stored in said capacitor for generating clock pulses;

a counting circuit for initiating a counting of said clock pulses in response to said actuation signal and generating an ignition signal upon counting clock pulses the number of which is equal to a predetermined preset count value; and a switching circuit for discharging charges stored in said capacitor through an ignition circuit in response to said ignition signal.

According to a further aspect of the invention, in a delay type detonating primer including a delay circuit, an igniting resistor connected to an output of the delay circuit, a fuse head applied on the igniting resistor and a main explosive arranged beside the fuse head, the improvement is characterized in that said delay circuit comprises a first capacitor for storing, electric energy supplied from an electric blaster;

an actuation circuit for generating an actuation signal in response to a stop of an energy supply from the electric blaster;

a clock pulse generating circuit for generating first and second clock pulses having the same frequency, but different phases in response to the actuating signal;

a pulse width converting circuit for receiving the first clock pulse and converting a pulse width of the first clock pulse to a value which is set externally in accordance with a desired delay time to produce a pulse width modulated first clock pulse;

a constant current pulse generating circuit for receiving said pulse width modulated first clock pulse and producing a constant current pulse having a predetermined constant amplitude and a pulse duration equal to that of the pulse width modulated first clock pulse;

a second capacitor for storing said constant current pulse;

a voltage detecting circuit for receiving said second clock pulse, detecting a voltage across said second capacitor in synchronism with the second clock pulse, and producing an ignition signal after the voltage across the second capacitor has exceeded a predetermined threshold value; and a switching circuit for responding to said ignition signal to discharge electric charges stored in said second capacitor through the igniting resistor.

According to further aspects of the invention, an electric blasting system for connecting a plurality of delay type detonating primers in parallel with an electric blaster, each detonatigg primer including a charging/discharging capacitor, a delay circuit connected to the capacitor, an igniting resistor connected to an output of the delay circuit, a fuse head applied on the igniting resistor, a main explosive arranged beside the fuse head, a first kind of connector connected to a free end of a first pair of lead wires each connected to respective terminals of the capacitor, and a second kind of connector connected to a free end of a second pair of lead wires each connected to the respective terminals of the capacitor comprises coupling a first kind of connector of a detonating primer to a second kind of connector of an adjacent detonating primer, and coupling a second kind of connector of said detonating primer to a first kind of connector of another adjacent detonating primer to form a series arrangement of detonating primers; and connecting at least one of first and second kinds of connectors of detonating primers at extreme ends of said series arrangement of detonating primers to the electric blaster via bus wires.

A delay type detonating primer according to the invention for use in the above mentioned electric blasting system comprises a charging/discharging capacitor, a delay circuit connected to the capacitor, an igniting resistor connected to an output of the delay circuit, a fuse head applied on the igniting resistor, a main explosive arranged beside the fuse head, a first kind of connector connected to a free end of a first pair of lead wires each connected to respective terminals of the capacitor, and a second kind of connector connected to a free end of a second pair of lead wires each connected to the respective terminals of the capacitor, whereby said first kind of connector is capable of being exclusively coupled with said second kind of connector.

DESCRIPTION OF THE PREFERRED EMBODIMENT

Figure 1:
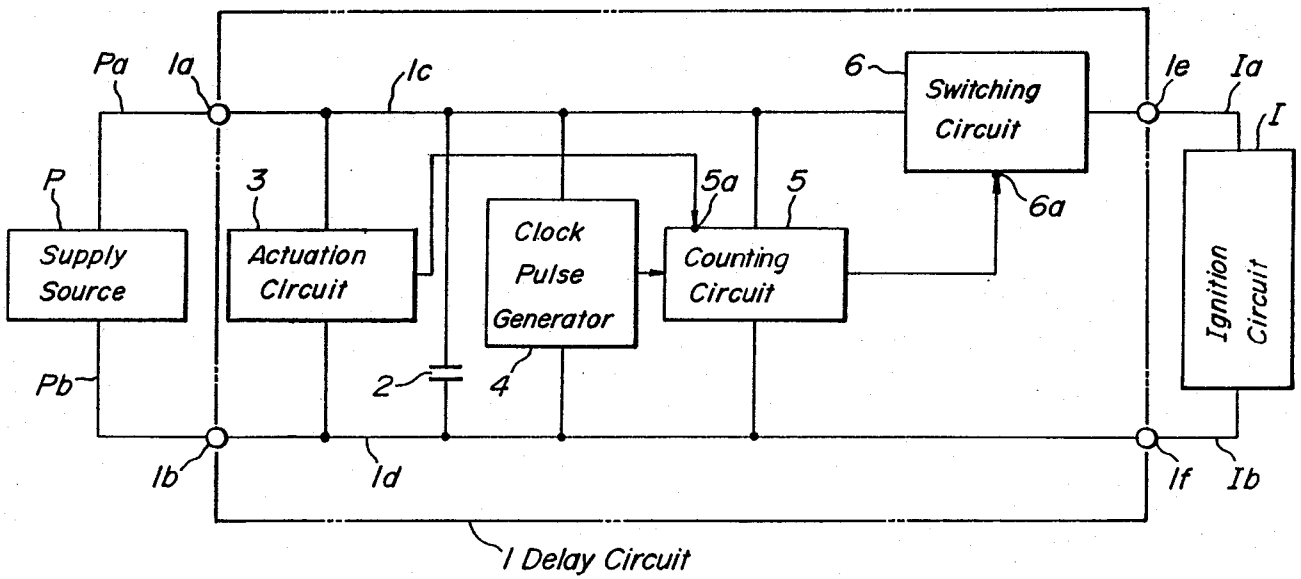
FIG. 1 is a block diagram showing a principal construction of the delay circuit according to the invention.

FIG. 1 is a block diagram showing a principal construction of the delay circuit for use in an electrical blasting according to the invention. Electric energy generated by a power supply source P is supplied to the delay circuit 1 via input terminals 1*a* and 1*b* to which are connected main conductors 1*c* and 1*d*, respectively. Across the main conductors 1*c* and 1*d* there are connected capacitor 2, actuation circuit 3, clock pulse generating circuit 4 and counting circuit 5. Further a switching circuit 6 is connected in series with the main conductor 1*c*. Therefore, the input terminal 1*a* is connected to an output terminal 1*e* via the main conductor 1*c* and switching circuit 6, while the input terminal 1*b* is connected to an output terminal 1*f* only via the main conductor 1*d*. The electric energy supplied from the power supply source P via wires $P_a$, $P_b$ is stored in the capacitor 2, so that a voltage across the capacitor increases gradually. When the voltage across the capacitor 2 exceeds a predetermined value, the circuits 3, 4 and 5 start to operate. Therefore, the clock pulse generating cirucit 4 starts to produce clock pulses. However, the counting cirucit 5 is not allowed to count the clock pulses, because it does not receive an actuation signal from the actuation circuit at its control input 5*a*. When the supply of the energy from the power supply source P is stopped, the actuation circuit 3 detects this to produce an actuation signal. This actuation signal is supplied to the control input 5*a* of the counting circuit 5 and the counting circuit starts to count the clock pulses supplied from the clock pulse generating circuit 4. During a time interval from an instant at which the clock pulse generator 4 starts to operate to an instant at which the actuation signal is generated from the actuation circuit 3 in response to the energy supply from the power supply source P, the clock pulse generating circuit has entered into the stable condition and has produced the clock pulses having a desired frequency. When the counting circuit 5 has counted clock pulses the number of which is equal to a preset count value which has been previously set by the use or maker, the counting circuit produces an ignition signal. This ignition signal is supplied to the control input 6*a* of the switching circuit 6. Then the switching circuit 6 becomes conductive and electrostatic charges stored in the capacitor 2 are discharged through the switching circuit 6 and output terminals 1*e* and 1*f* of the delay circuit. In this manner, the ignition circuit I connected to the output terminals 1e and 1f via wires $I_a$, $I_b$ is energized to effect the electric blasting. In this case, the delay time is determined by a time interval from the instant at which the supply of electric energy is stopped to the instant at which the ignition signal is generated from the counting circuit 5. During this time interval, the clock pulse generating circuit 4 produces the clock pulses in a very precise manner, so that the delay time can be determined very precisely.

Figure 2:
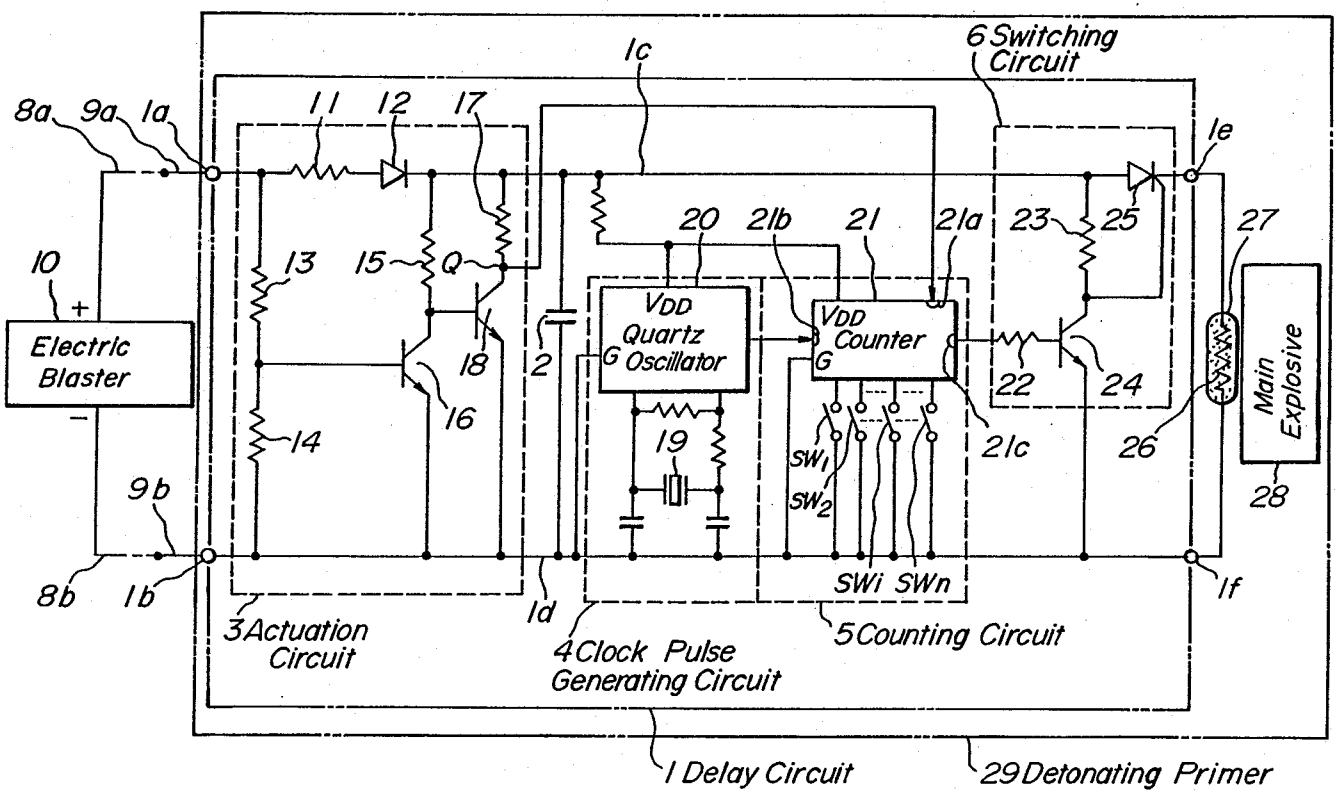
FIG. 2 is a circuit diagram of an embodiment of the delay circuit according to the invention provided in the detonating primer.

FIG. 2 is a circuit diagram illustrating an embodiment of the detonating primer comprising the delay circuit according to the invention. In FIG. 2, portions similar to those shown in FIG. 1 are denoted by the same reference numerals used in FIG. 1. In the present embodiment, the power supply source is constituted by an electric blaster 10 which is connected via bus wires 8a and 8b to leg wires 9a and 9b of the primer 29. To the leg wires 9a and 9b are connected input terminals 1a and 1b and main conductors 1c and and 1d of the delay circuit 1. An actuation circuit 3 for detecting the supply of electric energy from the electric blaster 10 comprises a current limiting resistor 11 and a diode 12 connected in series with the main conductor 1c, potentiometer resistors 13, 14 connected across the main conductors 1c and and 1d, a first transistor 16 having a base connected to a junction point of the resistors 13 and 14, a collector connected to the main conductor 1c via a resistor 15 and an emitter connected to the main conductor 1d, and a second transistor 18 having a base connected to the collector of the first transistor, a collector connected to the main conductor 1c through a resistor 17 and an emitter connected to the main conductor 1d.

When the electric blaster 10 is driven and a voltage is applied across the main conductors 1c and 1d via the bus wires 8a, 8b, leg wires 9a, 9b and input terminals 1a, 1b, a current flows through the resistors 13 and 14 and a base potential of the first transistor 16 becomes higher than an emitter potential, so that the first transistor 16 becomes conductive. Therefore, a base potential of the second transistor 18 becomes substantially equal to an emitter potential and the second transistor becomes non-conductive. In this manner, a potential at an output point Q of the actuation circuit 3 becomes substantially equal to the positive potential on the main conductor 1c.

Across the main conductors 1c and 1d are connected capacitor 2, clock pulse generating circuit 4 and counting circuit 5. The clock pulse generating circuit 4 and counting circuit 5 initiate to operate when a voltage across the capacitor 2 exceeds the operation voltage, and the clock pulse generating circuit 4 starts to produce clock pulses. In the present embodiment, the clock pulse generating circuit 4 is composed of a crystal oscillator 20 having a quartz vibrator 19. The precision of the oscillation frequency of the crystal oscillator 20 under the normal condition is very high, but at the start of operation the crystal oscillator operates unstably.

Figure 3:
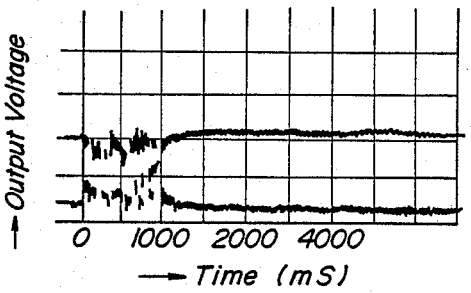
FIG. 3 is a graph showing an output voltage of the crystal oscillator.

FIG. 3 is a graph showing transient characteristics of the crystal oscillator 20. In FIG. 3, a time is plotted on a horizontal axis and an oscillation output voltage is plotted on the vertical axis. During a time period of about 1000 ms after the initiation of operation, the output voltage fluctuates at random and the oscillation is quite unstable. Therefore, if the oscillation output pulses in such an unstable condition are counted by the counting circuit 5, there might be introduced a very large error in the delay time. According to the invention, in order to avoid such an error, the output point Q of the actuation circuit 3 is connected to a reset terminal 21a of a counter 21 provided in the counting circuit 5. When the potential at the output point Q remains high, the counter 21 is kept reset so that it cannot count the clock pulses.

When the energy supply from the electric blaster 10 is stopped, the base potential of the first transistor 16 is decreased due to the diode 12, and the first transistor 16 becomes turned off. Therefore, the base potential of the second transistor 18 becomes positive and the second transistor changes the conductive condition, and the potential at the output point Q becomes negative at the main conductor 1d. Therefore, the reset condition of the counter 21 is released and it begins to count the clock pulses received at its input terminal 21b. Therefore, by continuing the supply of the electric energy from the electric blaster 10 to the detonating primer 29 over a time period which is longer than the unstable transient period of the crystal oscillator 20, the erroneous operation due to the unstable operation of the crystal oscillator can be completely removed.

To the counter 21 are connected a plurality of switches $SW_1$, $SW_2$, . . . $SW_n$. By closing a desired one $SW_i$ of these switches, a full count value of the counter corresponding to a desired delay time can be preset at will. When the counter 21 has counted the clock pulses up to the full count, it produces an ignition pulse at its output terminal 21c.

The ignition pulse thus generated is supplied to a switching circuit 6 which comprises resistors 22, 23, transistor 24 and thyristor 25. When the ignition pulse supplied from the output terminal 21c of the counter 21 is applied via the resistor 22 to a base of the transistor 24, the transistor is made conductive. Then a gate potential of the thyristor 25 becomes lower than an anode potential and the thyristor is turned on. Then the electric charges stored in the capacitor 2 are discharged through the thyristor 25 and an igniting resistor 26. Therefore, the temperature of the igniting resistor 26 is increased abruptly and a fuse head 27 applied around the igniting resistor is ignited. Subsequent to this, a main explosive 28 provided in the primer is exploded.

In the above embodiment, the delay circuit 1 is provided in a housing of the detonating primer 29 together wit the igniting resistor 26 having the fuse head 27 applied thereon and main explosive 28. However, the delay circuit may be installed in a separate housing. In such a case, the input terminals 1a and 1b are connected to the bus wires 8a and 8b and the output terminals 1e and 1f are connected to the leg wires of the usual instantaneous detonating primer.

Further, the delay circuit according to the invention may be equally installed in the detonating fuse. Then, the detonating fuse may be used as the delay type fuse.

Figure 4:
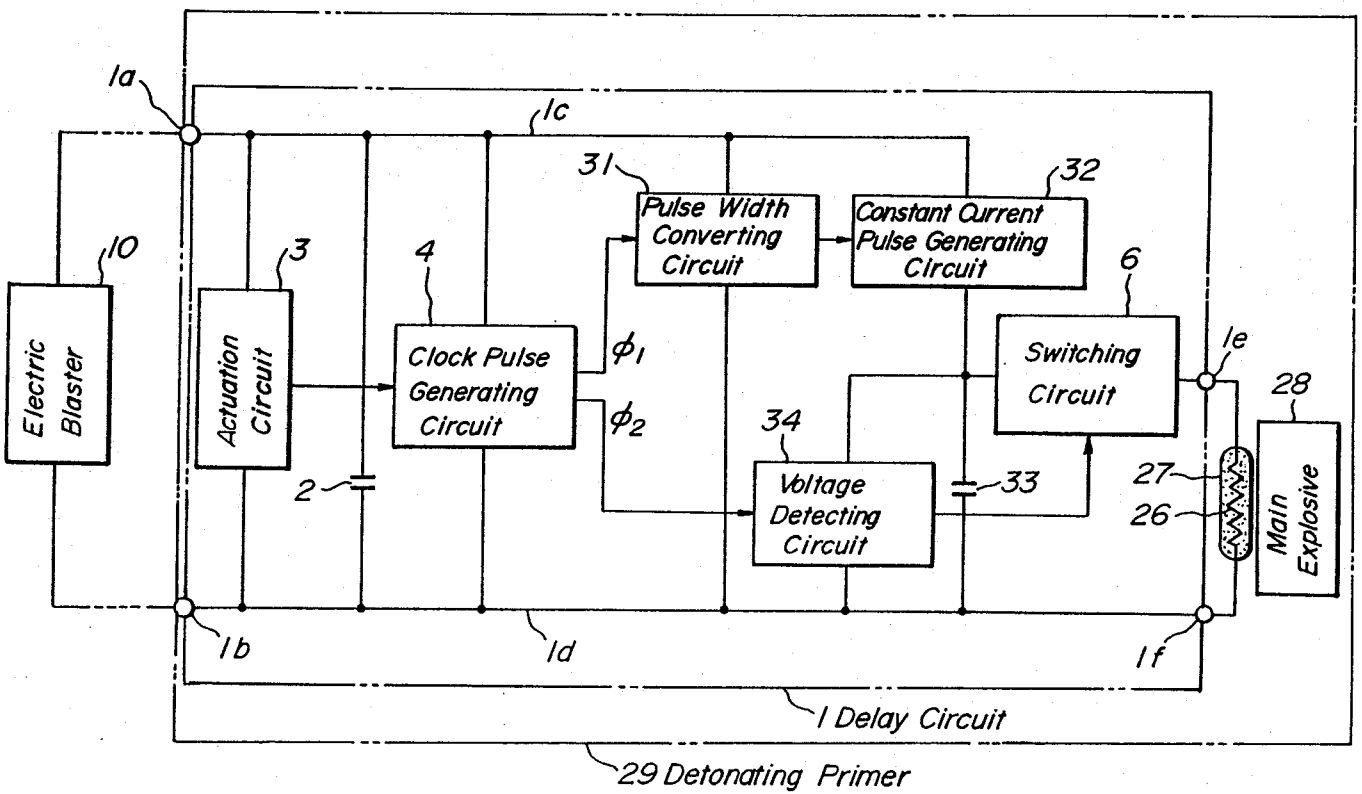
FIG. 4 is a block diagram illustrating a principal construction of the detonating primer according to the invention.

FIG. 4 is a block diagram illustrating a basic construction of an embodiment of the detonating primer according to the invention. Also in this embodiment, portions similar to those illustrated in FIGS. 1 and 2 are represented by the same reference numerals used in FIGS. 1 and 2. An electric blaster 10 is connected to input terminals 1a and 1b of the detonation primer 29, to said input terminals being connected main conductors 1c and 1d, respectively of a delay circuit 1. Across the main conductors 1c and 1d and are connected first capacitor 2, actuation circuit 3, clock pulse generating circuit 4, pulse width converting circuit 31 and a constant current pulse generating circuit 32. When the stop of energy supply from the electric blaster 10 is detected by the actuation circuit 3, the actuation signal is supplied to the clock pulse generating circuit 4. Then the clock pulse generating circuit 4 generates first and second clock pulses $\phi_1$ and $\phi_2$. These first clock pulses have the same frequency, but have different phases. A pulse width of the first clock pulse $\phi_1$ is changed by the pulse width converting circuit 31 in accordance with a factor which can be previously set. The first clock pulse having the converted or modulated pulse width is supplied to the constant current pulse generating circuit 32 which generates a constant current pulse in synchronism with the first clock pulse. The constant current pulse is charged in a second capacitor 33. A voltage across the second capacitor 33 is detected by a voltage detecting circuit 34 which is operated in synchronism with the second clock pulse $\phi_2$ supplied from the clock pulse generating circuit 4. When the voltage detecting circuit 34 detects that the voltage across the second capacitor 33 exceeds a predetermined threshold value, this circuit supplies an ignition signal to a switching circuit 6. Then, the switching circuit 6 is turned on and the electric charges stored in the second capacitor 33 are discharged through an igniting resistor 26 via the input terminals le and lf. In this manner, a fuse head 27 applied on the igniting resistor 26 is burnt, and subsequently a main explosive 28 is exploded. In the present embodiment, since the clock pulse generating circuit 4 starts to supply the first and second clock pulses $\phi_1$ and $\phi_2$ in response to the actuation signal which is generated by the actuation circuit 3 after a certain period has elapsed from the start of energy supply, these clock pulses have accurate frequency and amplitude. Further, since the voltage detecting circuit 34 operates in synchronism with the second clock pulse $\phi_2$ which has a fixed phase relation with respect to the constant current pulse supplied from the constant current pulse generating circuit 32, the ignition signal is generated always in synchronism with the second clock pulse $\phi_2$ and the delay time can be set in a purely digital manner. That is to say, in the present embodiment, the delay time can be set as an integral multiple of the period of the second clock pulse $\phi_2$.

Figure 5:
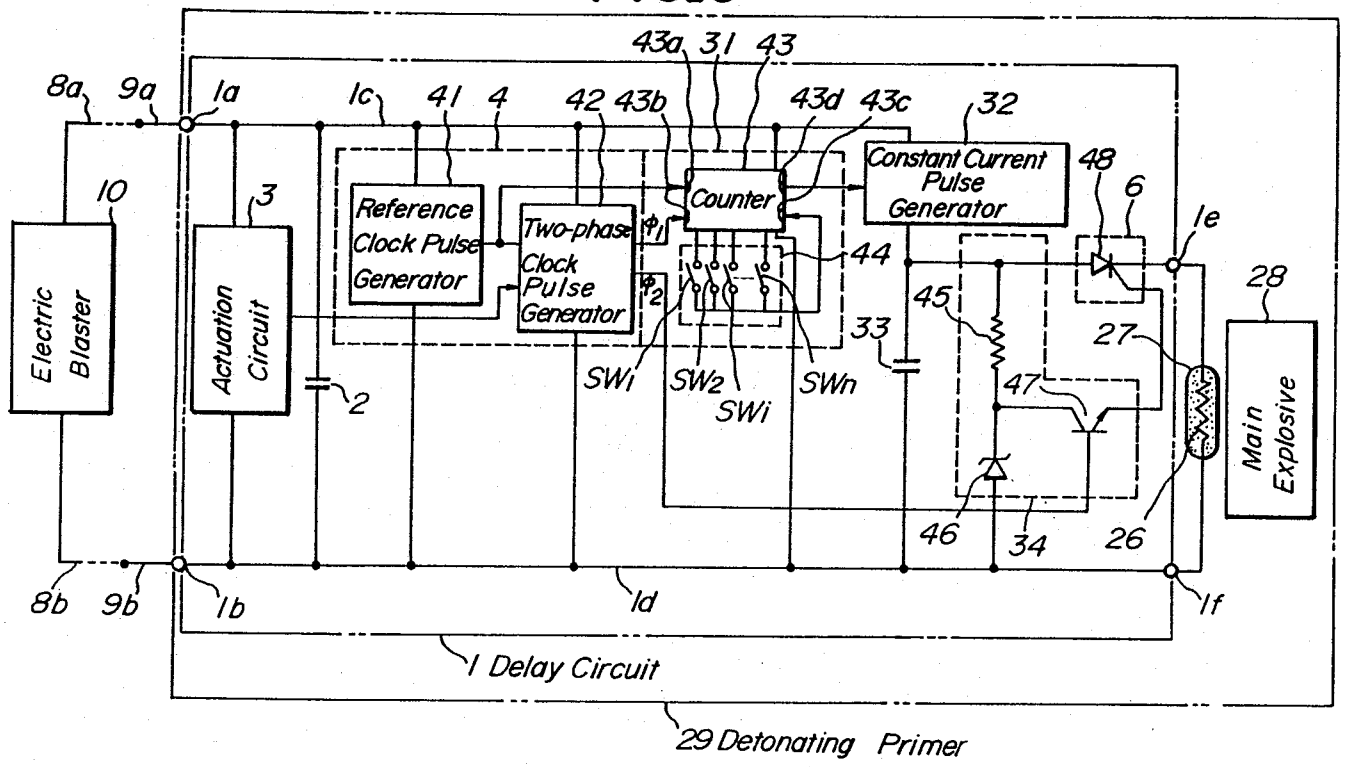
FIG. 5 is a a circuit diagram depicting an embodiment of the detonating primer according to the invention.

FIG. 5 is a circuit diagram showing a detailed construction of the detonating primer shown in FIG. 4. The clock pulse generating circuit 4 comprises a reference clock pulse generator 41 producing a reference clock pulse having a frequency of 32.678 KHz and a two phase clock pulse generator 42 which produces the first and second clock pulses $\phi_1$ and $\phi_2$ having the same frequency of 4 Hz (period is 250 ms), but different phases. The reference clock pulse generator 41 starts to generate the reference clock pulse unstably before the actuating signal is generated. However, in the present embodiment, the operation of the two phase clock pulse generator 42 is inhibited until the actuation signal is supplied from the actuation circuit 3. Therefore, the first and second clock pulses $\phi_1$ and $\phi_2$ supplied from the two phase clock pulse generator 42 are not affected by the initial unstable operation of the reference clock pulse generator 41. Then the reference clock pulse generator 41 can be formed by the highly precise oscillator comprising the quartz or ceramic vibrator.

The first clock pulse $\phi_1$ is supplied to the pulse width converting circuit 31 comprising a counter 43 and a switch circuit 44 having a plurality of switches $SW_1$, $SW_2$, . . . $SW_n$, one contact of each switches being connected, to the output, of different intermediate stages of the counter 43 and the other contacts being commonly connected to a reset input 43*c* of the counter. The counter 43 further comprises a count input 43*a* receiving the reference clock pulse, trigger input 43*b* receiving the first clock pulse $\phi 1$ and an output terminal 43*d*. The counter 43 produces at its output terminal 43*d* an output pulse which lasts for a time period from an instant at which the first clock pulse is received at the trigger input terminal 43*b* to an instant at which the reset signal is received at the reset terminal 43*c*. Therefore, by selectively closing one of the switches $SW_1 \sim SW_n$, the reset signal is generated when the counter has counted the reference clock pulses up to a counting stage to which the relevant switch is connected. In this manner, the width of the output pulse supplied from the output terminal 43*d* can be selected at will by selectively closing one of the switches in the switch circuit 44.

The first clock pulse $\phi_1$ whose pulse width has been converted or modulated in the manner explained above, is then supplied to the constant current pulse generating circuit 32 to produce the constant current pulse having the constant amplitude and the duration which is equal to that of the converted first clock pulse. The constant current pulse is supplied to the second capacitor 33 and is stored therein. The voltage detecting circuit 34 for detecting the voltage across the second capacitor 33 comprises a series circuit of a resistor 45 and a constant voltage diode (Zener diode) 46 connected across the second capacitor, and a transistor 47 having a collector connected to a junction point between the resistor 45 and Zener diode 46 and a base connected to the two-phase clock pulse generator 42 to receive the second clock pulse $\phi_2$. The switching circuit 46 comprises a thyristor 48 having a control gate electrode connected to the emitter of the transistor 47.

Figure 6:
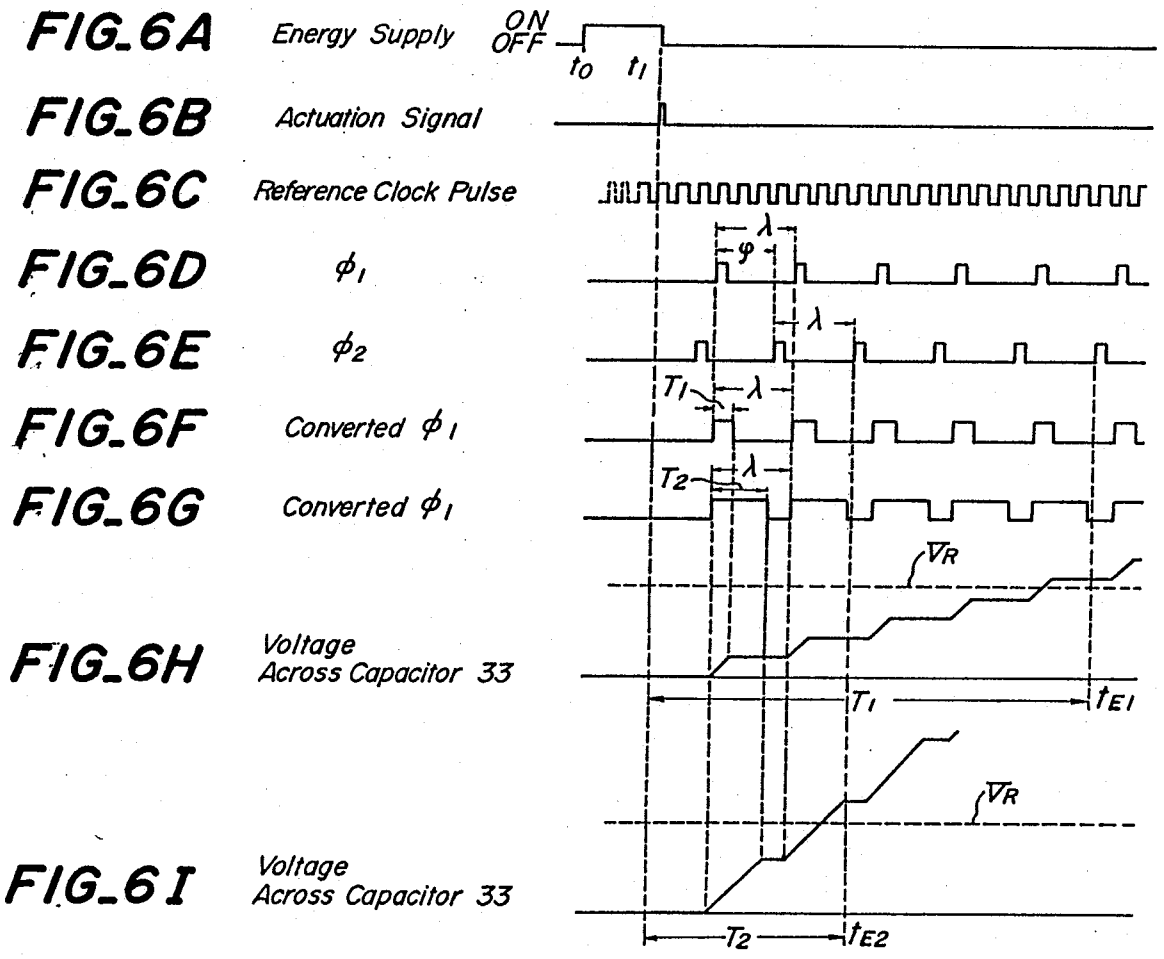
FIGS. 6A to 6I are signal waveforms for explaining the operation of the detonating primers shown in FIG. 5.

Now the operation of the delay type detonating primer shown in FIG. 5 will be explained with reference to signal waveforms illustrated in FIGS. 6A to 6I. As shown in FIG. 6A, at a timing $t_0$ the electric blaster 10 is actuated, and at a timing $t_1$ the energy supply is stopped. Usually a time period from $t_0$ to $t_1$ is one to several seconds. Then, the actuating circuit 3 generates the actuation signal at the timing $t_1$ as represented in FIG. 6B. The reference clock pulse generator 41 initiates to produce the reference clock pulses from a certain timing between $t_0$ to $t_1$ as shown in FIG. 6C. In FIG. 6C, the unstable operation of the reference clock pulse generator 41 is depicted by a dotted line. It should be noted that the reference clock pulse generator 41 has become stable by the timing tl at which the actuation signal is generated. Unless the actuation signal is generated, the two-phase clock pulse generator 42 could not operate, so that the first and second clock pulses $\phi_1$ and $\phi_2$ and the constant current pulse are not produced.

After the actuation signal has been produced, the two-phase clock pulse generator 42 produces the first and second clock pulses $\phi_1$ and $\phi_2$ shown in FIGS. 6D and 6E, respectively. These clock pulses have the same period $\lambda$, but have a relative phase difference $\psi$. The pulse difference $\psi$ is preferably determined slightly shorter than the period $\lambda$, because the pulse width can be changed within the phase difference $\psi$ and thus the large change in the pulse width can be attained. Further, in FIG. 6C, the repetition frequency of the reference clock pulse is shown extremely lower than the actual frequency for the sake of simplicity.

By selectively closing a desired one of the switches $SW_1$, $SW_2$ . . . $SW_n$, the counter 43 in the pulse width converting circuit 31 generates output pulses having difference durations $T_1$ and $T_2$ as shown by FIGS. 6F and 6G. The repetition periods of these output pulses are the same as the period $\lambda$ of the clock pulses $\phi_1$ and $\phi_2$. Since the leading edge of the output pulse of the counter 43 is coincided with that of the first clock pulse $\phi_1$, the output pulse can be regarded as the first clock pulse $\phi_1$ whose pulse width has been changed or converted. This pulse width can be precisely determined at a unit of the period of the reference clock pulse.

When the counter 43 generates the output pulse shown in FIG. 6F, the voltage across the second capacitor 33 increases in a stepwise manner as illustrated in FIG. 6H. In this case, since the width of the constant current pulse is short, the voltage across the capacitor increases rather gradually. Contrary to this, when the counter 43 generates the longer output pulse as depicted in FIG. 6G, the voltage across the capacitor 33 increases abruptly as shown in FIG. 6I. In this case, it should be noted that an inclination of the increasing portions of the voltages shown in FIGS. 6H and 6I is entirely the same, because the amplitude of the constant current pulse is always maintained constant.

In the present embodiment, the voltage across the second capacitor 33 is not always detected, but is measured in synchronism with the second clock pulse $\phi_2$. That is to say, when the second clock pulse $\phi_2$ is applied to the base of the transistor 47 in the voltage depicting circuit 34, the voltage across the second capacitor 33 is compared with a reference voltage $V_R$ which is determined by the breakdown voltage of the Zener diode 46. When the voltage across the second capacitor 33 is lower than the threshold voltage $V_R$, no current flows through the resistor 45 and potentials at anode and control gate become substantially equal to each other, so that the thyristor 48 is not turned on. When the voltage across the second, capacitor 33 exceeds the threshold value $V_R$ the potential at the junction point between the resistor 45 and Zener diode 46 is decreased. Thereafter, when the second clock pulse $\phi_2$ is applied to the base of the transistor 47, the decreased potential is applied to the control gate of the thyristor 48 and the thyristor becomes conductive. Then, the electric charges stored in the second capacitor 33 are discharged through the thyristor and igniting resistor 26. The igniting resistor 26 is heated, the fuse head 27 is burnt, and subsequently the main explosive 28 is exploded.

As shown in FIGS. 6H and 6I, when the width of the constant current is short, the delay time $T_1$ from the time $t_1$ at which the actuation signal is generated to the time $t_{E1}$ at which the thyristor 48 is turned on is long, but when the constant current pulse has a longer width, the delay time $T_2$ from $t_1$ to $t_{E2}$ becomes short. In this manner, according to the present embodiment, by suitably setting the pulse duration of the output signal from the counter 43 by selectively closing one of the switches $SW_1$, $SW_2$ . . . $SW_n$, the delay time can be adjusted. In this case, since the ignition signal is always generated in synchronism with the second clock pulse $\phi_2$, the delay time can be set in the digital manner at the unit of the period of the second clock pulse $\phi_2$. Therefore, the delay time can be entirely free from possible error in the capacitance value of the second capacitor 33.

In case of using a plurality of detonating primers, usually they are connected in series with the bus wires coupled with the electric blaster. Then, in order store in a capacitor a sufficient amount of energy in each detonating primer, it is preferable to increase the voltage applied across the capacitor, because the dimension of the capacitor can then be made smaller. However, in such an electric blasting system, it is necessary to provide an electric blaster having a very high output voltage. If such an electric blaster is used, when the number of detonating primers connected in series with each other is small, an excessively high voltage is applied to the primers and they might be broken. In order to avoid such a drawback, it is necessary to provide in each primer a protection circuit for high voltage or it is necessary to provide in the electric blaster a circuit for adjusting the voltage in accordance with the number of the detonating primers connected thereto. Therefore, it is quite preferable to connect a plurality of the detonating primers in parallel with the electric blaster. However, in such a case, it is necessary to extend the leg wires of all the primers to the electric blaster, so that the wiring operation becomes extremely complicated.

Figure 7:
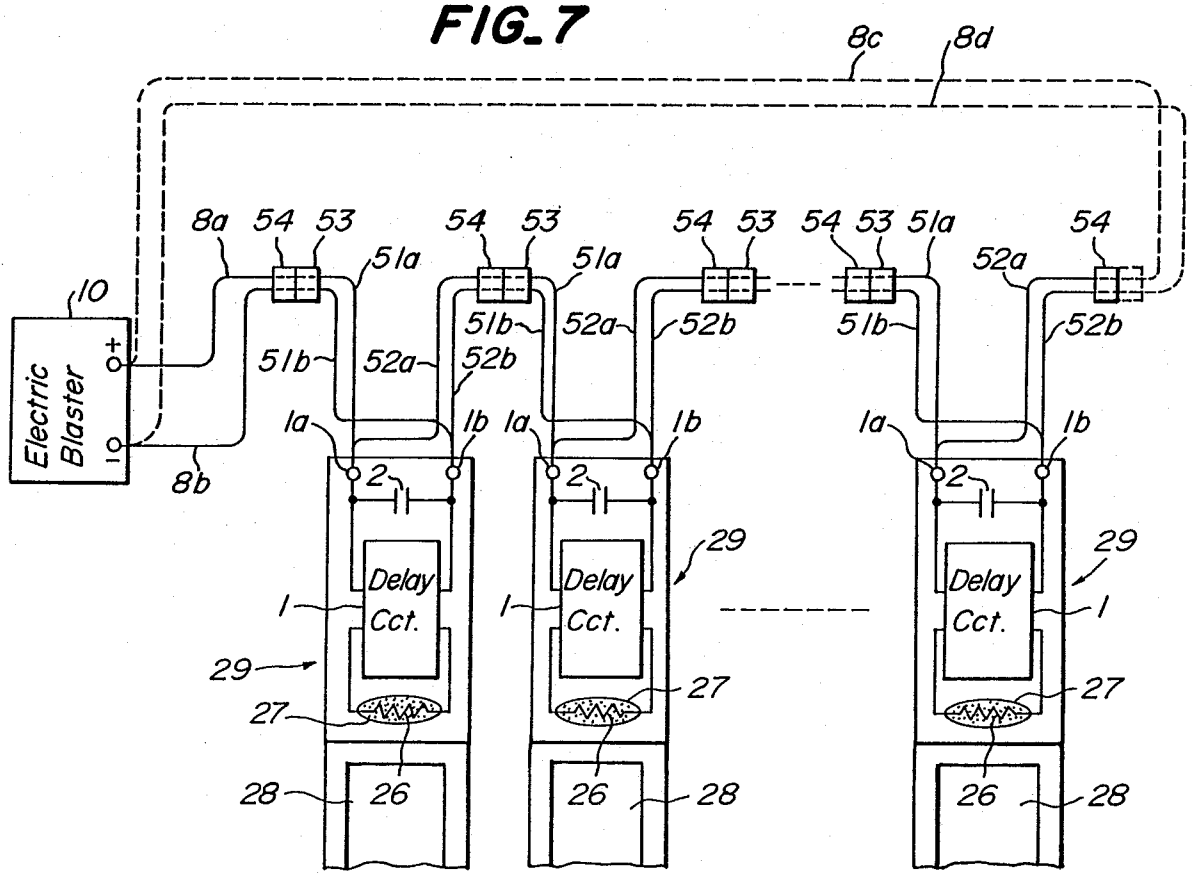
FIG. 7 is a circuit diagram showing a manner of connecting a number of detonating primers in the electric blasting system according to the invention.
Figure 8:
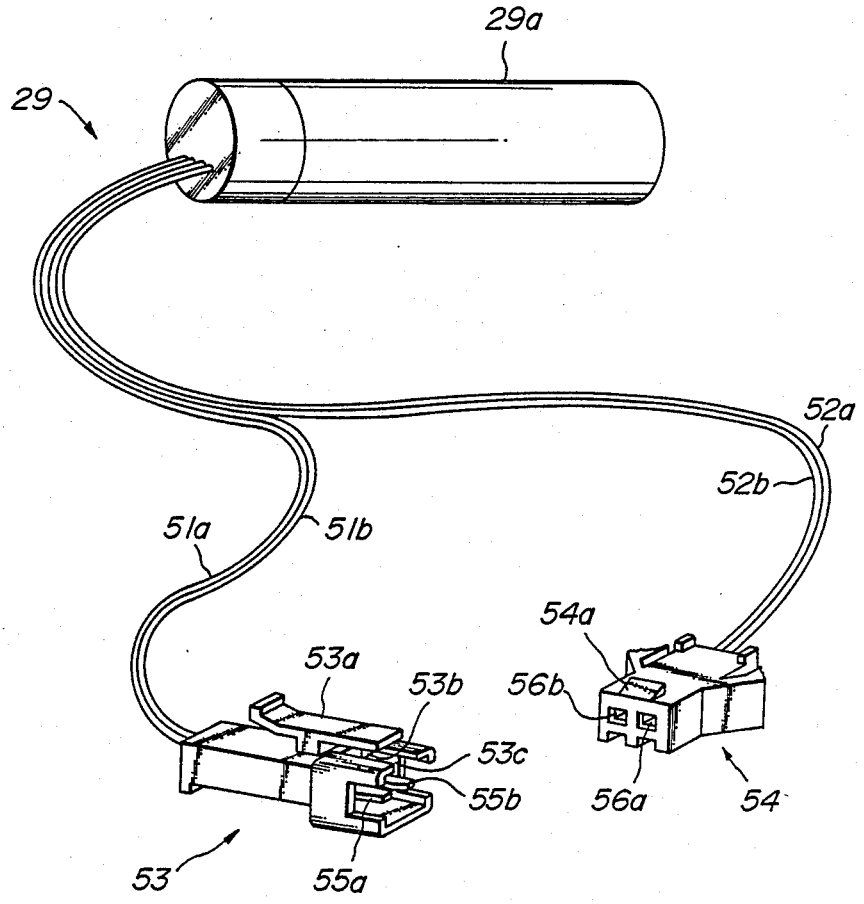
FIG. 8 is a perspective view illustrating a construction of the detonating primer used in the system depicted in FIG. 7.
Figure 9:
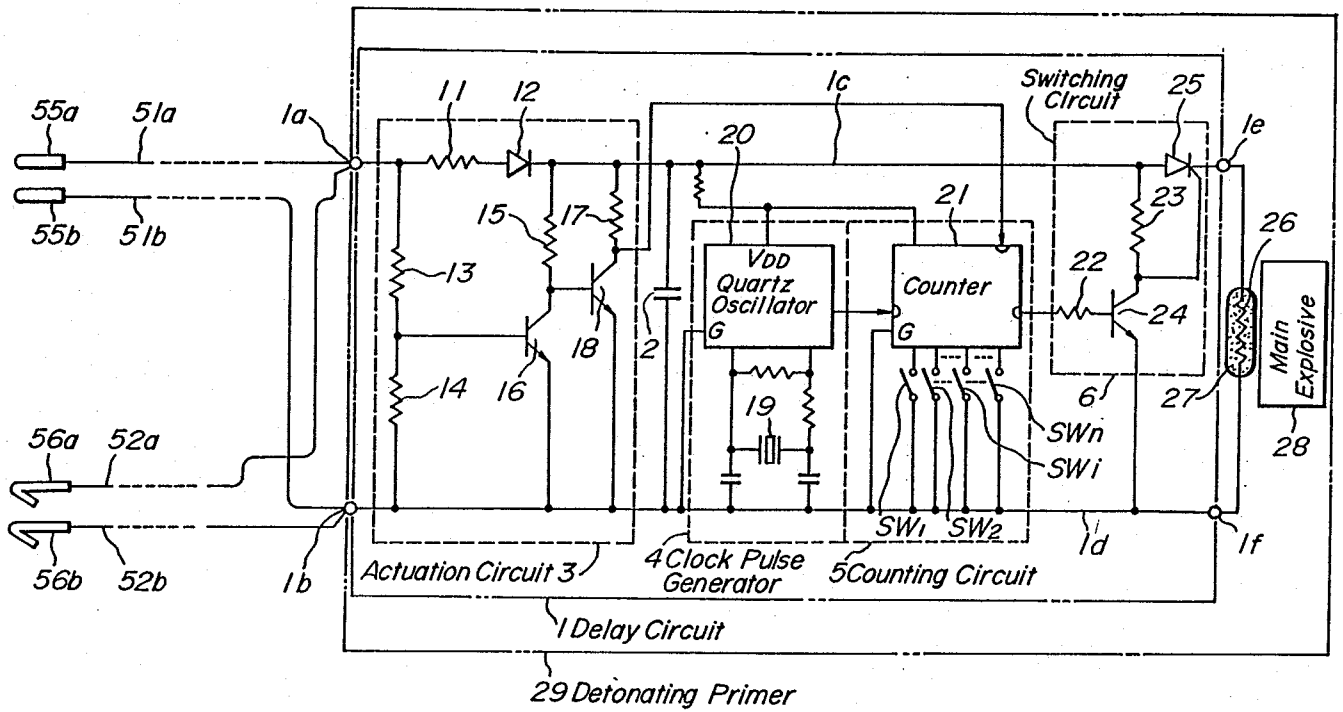
FIG. 9 is a circuit diagram showing an internal construction of the detonating primer illustrated in FIG. 8.

FIGS. 7, 8 and 9 show an embodiment of the electric blasting system according to the invention, in which a number of detonating primers can be connected in parallel with the electric blaster by connecting leg wires of these primers in the serial connection mode. Each detonating primer 29 comprises input terminals 1*a*, 1*b*, charging/discharging capacitor 2 connected across the input terminals, delay circuit 1 connected to the capacitor, igniting resistor 26 connected to the delay circuit, fuse head 27 applied on the resistor and main explosive 28. To the input terminals 1*a* and 1*b* are connected first set of lead wires 51*a* and 51*b* and a second set of lead wires 52*a* and 52*b*, respectively. Free ends of the first set of lead wires 51*a* and 51*b* are connected to a first kind of connector 53, and free ends of the second set of lead wires 52*a* and 52*b* are connected to a second kind of connector 54 which is exclusively coupled with the first kind of connector 53. Positive and negative output terminals 10*a* and 10*b* of an electric blaster 10 are connected to bus wires 8*a* and 8*b*, respectively and free ends of the bus wires are connected to the second kind of connector 54.

In case of connecting a plurality of detonating primers 29 to the electric blaster 10, the first kind of connector 53 connected to the first set of lead wires 51*a* and 51*b* of the first detonating primer is coupled with the second kind of connector 54 connected to the bus wires 8*a* and 8*b*. Then the second kind of connector 54 of the first primer is coupled with the first kind of connector 53 of the second detonating primer. In this manner, first and second kinds of connectors 53 and 54 of successive detonating primers are coupled with each other. The second kind of connector 54 of the last detonating blaster is made free without being coupled with the first kind of connector. Then, all the detonating primers 29 are connected in series with the electric blaster 10, while the connecting operation is the same as that of the series connection. It should be noted that the second kind of connector 54 of the last detonating primer may be connected to the electric blaster 10 via a first kind of connector 53 and auxiliary bus wires 8*c*, 8*d* as illustrated by dotted lines. Then, even if the connection between the first and second kinds of connectors 53 and 54 might be disconnected at a point, the capacitors 2 of all the detonating primers 29 may be charged positively and all the detonating primers may be exploded without failure.

FIG. 8 is a perspective view illustrating an embodiment of the detonating primer according to the invention. The detonating primer comprises a housing 29*a* in which the capacitor 2, delay circuit 1, igniting resistor 26 with the fuse head 27 and main explosive 28 are all installed. The lead wires 51*a* and 51*b* are connected to a pair of pins 55*a* and 55*b* provided in the first kind of connector 53. The first kind of connector 53 comprises a resilient lever portion 53*a* and a triangular projection 53*b* formed at a tip of the lever portion. The second kind of connector 54 comprises a wedge-shaped projection 54*a* which engages with the triangular projection 53*b* of the first kind of connector 53. In the second kind of connector 54, there are arranged a pair of contacts 56*a* and 56*b* which are brought into contact with the pins 55*a* and 55*b*, respectively, when the first and second kinds of connectors 53 and 54 are coupled with each other. In order to avoid that these connectors 53 and 54 are coupled with each other up side down or in an inverted manner, in the housing of the first kind of connector 53, there is formed a recess 53*c* into which the projection 54*a* of the connector 54 is inserted when the connectors 53 and 54 are coupled with each other in a correct manner.

FIG. 9 is a circuit diagram showing the internal construction of the detonating primer of the present embodiment. The construction of the delay circuit 1, the igniting resistor 26, fuse head 27 and main explosive 28 are the entirely same as that of the embodiment illustrated in FIG. 2 and its detailed explanation is omitted here. To the input terminal 1*a* of the delay circuit 1 are connected the lead wires 51*a* and 52*a*, and to the other input terminals 1*b* are connected the lead wires 51*b* and 52*b*, the free ends of the lead wires 51*a* and 51*b* are connected to the pins 55*a* and 55*b*, respectively and the free ends of the lead wires 52*a* and 52*b* are connected to the contacts 56*a* and 56*b*, respectively.

It should be noted that since the resistance of the lead wires 51*a*, 51*b*, 52*a* and 52*b* can be made smaller than about 100 Ω, usually 10~30 Ω and the current limiting resistor 11 is about 10 KΩ, the charging resistances may be considered substantially this same for respective detonating primers and any problem could not occur practically.

In the embodiment shown in FIG. 9, the delay circuit is formed by the same delay circuit illustrated in FIG. 2, but it is apparent that the delay circuit depicted in FIG. 5 may be equally installed in the detonating primer shown in FIG. 9.

What is claimed is:

1. A delay circuit for use in electric blasting comprising:

a capacitor for storing electric energy supplied from an energy supply source;

an actuation circuit for detecting a stop of the supply of said electric energy from the energy supply source and for generating an actuation signal in response thereto;

a clock pulse generating cirucit energized with energy stored in said capacitor for generating clock pulses;

a counting circuit for initiating a counting of said clock pulses in response to said actuation signal and generating an ignition signal upon counting clock pulses the number of which is equal to a predetermined preset count value; and a switching circuit for discharging charges stored in said capacitor through an ignition circuit in response to said ignition signal.

2. A delay circuit according to claim 1, wherein said clock pulse generating cirucit comprises a high precision oscillator including a quartz vibrator.

3. A delay circuit according to claim 2, wherein the delay circuit further comprises first and second input terminals to be connected to an electric blaster via bus wires, first and second main conductors each connected to said first and second input terminals, said actuation circuit, clock pulse generating circuit and counting circuit being connected across said first and second main conductors and said switching circuit being connected in series with said first main conductor, and first and second output terminals, said first output terminal being connected to an output terminal of said switching circuit and said second output terminal being connected to said second main conductor.

4. A delay circuit according to claim 3, wherein said actuation circuit comprises potentiometer resistors connected across said first and second main conductors, a series circuit of a current limiting resistor and a diode connected in series with said first main conductor, a first transistor having a base connected to a junction point of said potentiometer resistors, an emitter connected to said second main conductor and a collector, a resistor connected between said collector of the first transistor and a cathode of said diode, a second transistor having a base connected to the collector of the first transistor, a collector connected to the second lead conductor and an emitter, and a resistor connected across the collector of the second transistor and the cathode of the diode, whereby said actuation signal is generated from the collector of the second transistor.

5. A delay circuit according to claim 3, wherein said counting circuit comprises a counter having counting stages, a count input connected to an output of the clock pulse generating circuit and a reset input connected to an output of the actuation circuit and a switch circuit having a plurality of switches each connected across different counting stages of the counter and the second main conductor, whereby a full count value of the counter is set by selectively closing one of said switches.

6. A delay circuit according to claim 3, wherein said switching circuit comprises a transistor having a base, an emitter connected to the second main conductor, and a collector, a resistor connected across the base of the transistor and an output of the counting circuit, a resistor connected across the collector of the transistor and the first main conductor, and a thyristor having an anode-cathode path connected in series with the first main conductor and a control gate connected to the collector of the transistor.

7. A delay circuit according to claim 1, wherein said clock pulse generating circuit comprises an high precision oscillator including a ceramic vibrator.

8. A delay type detonating primer comprising:

a first capacitor for storing electric energy supplied from an electric detonator;

an actuation circuit for generating an actuation signal in response to a stop of an energy supply from an electric blaster;

a clock pulse generating circuit for generating first and second clock pulses having the same frequency, but different phases in response to the actuating signal;

a pulse width converting circuit for receiving the first clock pulse and converting a pulse width of the first clock pulse to a value which is set externally in accordance with a desired delay time to produce a pulse width modulated first clock pulse;

a constant current pulse generating circuit for receiving said pulse width modulated first clock pulse and producing a constant current pulse having a predetermined constant amplitude and a pulse duration equal to that of the pulse width modulated first clock pulse;

a second capacitor for storing said constant current pulse;

a voltage detecting circuit for receiving said second clock pulse, detecting a voltage across said second capacitor in synchronism with the second clock pulse, and producing an ignition signal after the voltage across the second capacitor has exceeded a predetermined threshold value; and a switching circuit for responding to said ignition signal to discharge electric charges stored in said second capacitor through the igniting resistor.

9. A primer according to claim 8, wherein the primer further comprises first and second input terminals, first and second leg wires each connected to said first and second input terminals, first and second main conductors each connected to said first and second input terminals, respectively, said first capacitor, actuation circuit, clock pulse generating circuit, pulse width converting circuits and constant current generating circuit being connected across said first and second main conductors, an output line connected to an output of the constant current generating circuit, said second capacitor and voltage detecting circuit being connected across said output line and the second main conductor, and said switching circuit being connected in series with said output line, and first and second output terminals connected to said output line and second main conductor, respectively.

10. A primer according to claim 9, wherein said clock pulse generating circuit comprises a reference clock pulse generator producing a reference clock pulse and a two-phase clock pulse generator having an input for receiving said reference clock pulse, a reset input for receiving the actuation signal supplied from the actuation circuit and first and second outputs for generating the first and second clock pulses, respectively.

11. A primer according to claim 10, wherein said pulse width converting circuit comprises:

a counter having a number of counting stages, a count input connected to the output of the reference clock pulse generator to receive the reference clock pulse, a trigger input connected to the first output of the two-phase clock pulse generator to receive the first clock pulse, a reset input and an output, and a switching circuit including a plurality of switches connected between different counting stages and the reset input of the counter, whereby a width of the output pulse supplied from the output is set by selectively closing one of the switches.

12. A primer according to claim 10, wherein said voltage detecting circuit comprises a series circuit of a resistor and a constant voltage diode, and a transistor having a base connected to said second output of the two-phase clock pulse generator, a collector connected to a junction point between said resistor and diode and an emitter connected to said switching circuit.

13. A primer according to claim 12, wherein said switching circuit comprises a thyristor having an anode-cathode path connected in series with said output line and a control gate connected to the emitter of said transistor of the voltage detecting circuit.

14. A primer according to claim 8, wherein the phase difference between the first and second clock pulses is set slightly smaller than a period of the first and second clock pulses.

15. An electric blasting system for blasting a plurality of delay type detonating primers by connecting them in parallel with an electric blaster, each detonating primer including a charging/discharging capacitor, a delay circuit connected to the capacitor, an igniting resistor connected to an output of the delay circuit, a fuse head applied on the igniting resistor, a main explosive arranged beside the fuse head, a first kind of connector connected to a free end of a first pair of lead wires each connected to respective terminals of the capacitor, and a second kind of connector connected to a free end of a second pair of lead wires each connected to the respective terminals of the capacitor comprising:

coupling a first kind of connector of a detonating primer to a second kind of connector of an adjacent detonating primer, and coupling a second kind of connector of said detonating primer to a first kind of connector of another adjacent detonating primer to form a series arrangement of detonating primers; and connecting at least one of first and second kinds of connectors of detonating primers at extreme ends of said series arrangement of detonating primers to the electric blaster via bus wires.

16. A system according to claim 15, wherein the other of first and second kinds of connectors of detonating primers at extreme ends of said series arrangement of detonating primers is also connected to the electric blaster via auxiliary bus wires.

17. A delay type detonating primer comprising:

a charging/discharging capacitor, a delay circuit connected to the capacitor, an igniting resistor connected to an output of the delay circuit, a fuse head applied on the igniting resistor, a main explosive arranged beside the fuse head, a first kind of connector connected to a free end of a first pair of lead wires each connected to respective terminals of the capacitor, and a second kind of connector connected to a free end of a second pair of lead wires each connected to the respective terminals of the capacitor, whereby said first kind of connector is capable of being exclusively coupled with said second kind of connector.

18. A primer according to claim 17, wherein said first kind of connector comprises a first housing and a pair of pins installed in the first housing, said pins being connected to lead wires of the first pair, said second kind of connector comprises a second housing and a pair of contacts installed in said second housing, said contacts being connected to the lead wires of the second pair, and said first and second housings comprise a mechanism for detachably coupling the first and second housings with each other, while said pins are brought into contact with said contacts.

19. A primer according to claim 18, wherein said first and second housings further comprise a mechanism for preventing the first and second housings from being coupled with each other in an inverted manner.

20. A primer according to claim 17, wherein said delay circuit comprises:

an actuation circuit for detecting a stop of energy supply from an electric blaster to generate an actuation signal;

a clock pulse generating circuit energized with energy stored in said capacitor for generating clock pulses;

a counting circuit for initiating a counting of said clock pulses in response to said actuation signal and generating an ignition signal upon counting clock pulses the number of which is equal to a predetermined preset count value; and a switching circuit for discharging charges stored in said capacitor through said igniting resistor in response to said ignition signal.

21. A primer according to claim 18, wherein said delay circuit comprises:

an actuation circuit for generating an actuation signal in response to a stop of an energy supply from an electric blaster;

a clock pulse generating circuit for generating first and second clock pulses having the same frequency, but different phases in response to the actuating signal;

a pulse width converting circuit for receiving the first clock pulse and converting a pulse width of the first clock pulse to a value which is set externally in accordance with a desired delay time to produce a pulse width modulated first clock pulse;

a constant current pulse generating circuit for receiving said pulse width modulated first clock pulse and producing constant current pulse having a predetermined constant amplitude and a pulse duration equal to that of the pulse width modulated first clock pulse;

a second capacitor for storing said constant current pulse;

a voltage detecting circuit for receiving said second clock pulse, detecting a voltage across said second capacitor in synchronism with the second clock pulse, and producing an ignition signal after the voltage across the second capacitor has exceeded a predetermined threshold value; and a switching circuit for responding to said ignition signal to discharge electric charges stored in said second capacitor through the igniting resistor.

* * * * *